US010986869B2

(12) United States Patent
Zinovik et al.

(10) Patent No.: US 10,986,869 B2
(45) Date of Patent: Apr. 27, 2021

(54) INDUCTIVE HEATING DEVICE AND SYSTEM FOR AEROSOL GENERATION

(71) Applicant: PHILIP MORRIS PRODUCTS S.A., Neuchatel (CH)

(72) Inventors: Ihar Nikolaevich Zinovik, Peseux (CH); Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 95 days.

(21) Appl. No.: 15/121,554

(22) PCT Filed: May 21, 2015

(86) PCT No.: PCT/EP2015/061199
§ 371 (c)(1),
(2) Date: Aug. 25, 2016

(87) PCT Pub. No.: WO2015/177254
PCT Pub. Date: Nov. 26, 2015

(65) Prior Publication Data

US 2017/0119054 A1 May 4, 2017

(30) Foreign Application Priority Data

May 21, 2014 (EP) ..... 14169190

(51) Int. Cl.
*A24F 47/00* (2020.01)
*H05B 6/02* (2006.01)
*H05B 6/10* (2006.01)

(52) U.S. Cl.
CPC ..... *A24F 47/008* (2013.01); *H05B 6/02* (2013.01); *H05B 6/105* (2013.01)

(58) Field of Classification Search
CPC ..... A24F 47/00; A24F 47/008; H05B 6/00; H05B 6/06; H05B 6/10; H05B 6/105; H05B 6/02; A61M 11/042; A61M 15/06
(Continued)

(56) References Cited

U.S. PATENT DOCUMENTS 5,144,962 A * 9/1992 Counts ..... A24F 47/008 131/194
5,613,505 A * 3/1997 Campbell ..... A24F 47/008 128/202.21
(Continued)

FOREIGN PATENT DOCUMENTS

CN 201522075 7/2010
CN 10791198 8/2010
(Continued)

OTHER PUBLICATIONS

PCT Search Report and Written Opinion for PCT/EP2015/061199 dated Aug. 11, 2015 (11 pages).
(Continued)

*Primary Examiner* — Alex M Valvis
(74) *Attorney, Agent, or Firm* — Mueting Raasch Group

(57) ABSTRACT

The inductive heating device (1) for aerosol-generation comprises a device housing (10) comprising a cavity (13) having an internal surface for receiving at least a portion of an aerosol-forming insert (2) comprising an aerosol-forming substrate and a susceptor. The device housing (10) further comprises a pin (14) extending into the cavity (13). The device (1) further comprises an induction coil (15) arranged along the pin (14) and a power source (11) connected to the induction coil (15) and configured to provide a high frequency current to the induction coil (15).

15 Claims, 1 Drawing Sheet

(58) Field of Classification Search
USPC ..... 131/194
See application file for complete search history.

(56) References Cited

U.S. PATENT DOCUMENTS

| | | | | |
|---|---|---|---|---|
| 5,902,501 | A * | 5/1999 | Nunnally | A24F 47/008 219/263 |
| 6,615,840 | B1 * | 9/2003 | Fournier | A24D 1/02 131/194 |
| 7,185,659 | B2 * | 3/2007 | Sharpe | A24F 47/008 131/194 |
| 2004/0149737 | A1 * | 8/2004 | Sharpe | A24F 47/008 219/635 |
| 2011/0155718 | A1 * | 6/2011 | Greim | A24F 47/008 219/507 |
| 2013/0306064 | A1 * | 11/2013 | Thorens | A24F 47/008 128/202.21 |

FOREIGN PATENT DOCUMENTS

| | | |
|---|---|---|
| EP | 2444112 | 4/2012 |
| EP | 2609821 | 7/2013 |
| WO | WO 95/27411 | 10/1995 |
| WO | WO 2013/102609 | 7/2013 |
| WO | WO 2014/048745 | 4/2014 |

OTHER PUBLICATIONS

Office Action issued in China for Application No. 201580019380.6 dated Jun. 17, 2019 (13 pages). English translation included.

* cited by examiner

INDUCTIVE HEATING DEVICE AND SYSTEM FOR AEROSOL GENERATION

This application is a U.S. National Stage Application of International Application No. PCT/EP2015/061199, filed May 21, 2015, which was published in English on Nov. 26, 2015, as International Patent Publication WO 2015/177254 A1. International Application No. PCT/EP2015/061199 claims priority to European Application No. 14169190.7 filed May 21, 2014.

The invention relates to inductively heatable smoking devices, wherein an aerosol is generated by inductively heating an aerosol-forming substrate.

Prior art electric heating devices for aerosol generation are mostly large in size and have an energy consumption which is challenging for batteries available in the devices. While use of inductive heating bears advantages in view of energy efficiency, electromagnetic fields are generated that should be shielded.

Thus, there is a need for improved inductive heating devices for aerosol-generation that address at least some of the prior art drawbacks.

According to an aspect of the invention there is provided an inductive heating device for aerosol-generation. The device comprises a device housing comprising a cavity having an internal surface for receiving at least a portion of an aerosol-forming insert comprising an aerosol-forming substrate and a susceptor. The device housing further comprises a pin extending into the cavity. The device further comprises an induction coil arranged along the pin and a power source connected to the induction coil and configured to provide a high frequency current to the induction coil.

Inductive heating is known to be an efficient way of heating since heat may be generated at the location where it is desired. In addition, inductive heating allows for a contactless heating. In the device according to the invention, the induction coil may be kept separate from an aerosol-generating substrate. It may be kept separate from a susceptor provided for being heated by electromagnetic fields generated by the induction coil and for heating the aerosol-forming substrate. This facilitates a cleaning of the device. In addition, in some embodiments no residues may condense on the induction coil, which may generate undesirable aerosols upon reuse of the device. Yet further, the arrangement of the induction coil along a pin, which pin extends into the cavity provided for accommodation of the aerosol-forming insert, facilitates a good distribution of heat production in the aerosol-forming substrate. For example, the induction coil may be arranged at a position of the pin and may extend along a length of the pin such as to correspond to the extent of an aerosol-forming substrate provided in the aerosol-forming insert that shall be heated. Preferably, pin and induction coil are arranged such as to be at least partially surroundable by the aerosol-forming insert comprising the aerosol-forming substrate and the susceptor once the insert is accommodated in the cavity.

By arranging the induction coil in a center of the device rather than in a circumferential portion of the device, the device may be minimized. No circumferential space is required for the induction coil. In addition, with a centrally arranged induction coil, magnetic shielding is performed by the aerosol-forming insert or rather the susceptor provided with the insert. By this, no or a neglectable amount of electromagnetic radiation may leave the device and magnetic shielding of the device may be omitted.

A central arrangement of the induction coil bears the further advantage that an aerosol-forming substrate to be heated typically has a substantially ring-shaped cross section (or other outer forms but with an actual space for the pin). Thus, in general, a thickness of the aerosol-forming substrate to be penetrated by the electromagnetic field is smaller than with for example entirely cylindrically shaped substrates. This may further support a homogeneous heating and a reduction in energy consumption.

According to an aspect of the device according to the invention, the induction coil is arranged within the pin and is not in contact with the cavity. In such an arrangement the induction coil and a power source may be kept entirely separated from a cavity for accommodating the aerosol-forming insert. Replacement of an insert may thus be performed without contact to the induction coil, thus without the risk of altering the induction coil or electrical contacts. Also cleaning of the cavity is facilitated. No hard to reach coil windings have to be cleaned, which might otherwise possibly be harmed upon cleaning. In addition, the pin may be constructed in a very solid manner. This may avoid the risk of bending or breaking for example an induction coil arranged in the cavity upon repeated introduction of an aerosol-forming insert. A pin may for example also be used to prong an aerosol-forming insert when being inserted into the cavity. In these embodiments, a preformed opening in the aerosol-forming insert may be omitted and the insert may simply be pushed onto the pin. The pin may be provided with a pointed distal tip in order to facilitate such a 'pronging'. A pointed tip may in general be provided to facilitate an alignment of the insert upon insertion into the cavity.

In some preferred embodiments, where the induction coil is not in contact with the cavity, the induction coil is moulded into the pin.

According to another aspect of the device according to the invention, the induction coil is wound around the pin. By this, an energy distribution along an entire cavity or only at a required location in the cavity may be provided. The arrangement of the induction coil outside along the pin may enable a closer arrangement of the induction coil to the aerosol-forming insert. Such an arrangement may be preferred depending on the design of the aerosol-forming insert, for example, if the aerosol-forming insert is a cartridge containing an aerosol-forming liquid. In these embodiments, a cartridge housing may serve as wall between induction coil and aerosol-forming substrate such that direct contact of the aerosol-forming substrate with the induction coil may be prevented.

According to a further aspect of the device according to the invention, the pin and the induction coil are arranged along a central longitudinal axis of the cavity. Such a central arrangement allows for a regular, symmetric distribution of the electromagnetic field generated by the induction coil inside the cavity, from the magnetic axis of the induction coil to a periphery or circumference of the cavity. Preferably, a circumferential portion of the inner surface of the cavity or side walls and the pin are of cylindrical shape. In combination with a central arrangement, the electromagnetic field distribution is basically homogeneous throughout the cavity and thus allows for a symmetric or regular heating of the aerosol-forming insert accommodated in the cavity.

According to another aspect of the device according to the invention, two of more induction coils are arranged along the pin and next to each other. By, this, control of aerosol generation may be facilitated. For example, a variety of heating possibilities of an aerosol-forming insert accommodated in the cavity is provided. For example, different induction coils may be provided with different amounts of energy. The energy may be provided at different times, for example subsequently. By this, different areas of an aerosol-forming substrate may be heated and to different extents. If for example a tobacco containing aerosol-forming substrate is used, a smoking experience may be enhanced or a nicotine delivery may be altered during smoking.

According to yet another aspect of the device according to the invention, the pin is integrally formed with the device housing. This may facilitate manufacturing of the device by reducing manufacturing step. In addition, a separate joint between pin and device housing may be omitted. Preferably, the device housing as well as the pin is made of a plastics material. Pin and housing may for example be manufactured by injection moulding.

Preferably an aerosol-generating insert snugly fits into the cavity of the device housing such that it may be held by the internal surface of the cavity, or by the pin or by both. The internal surface of the cavity, the pin or the device housing may also be formed to provide better hold for the inserted insert. According to another aspect of the device according to the invention, the device housing comprises retaining members for holding the aerosol-forming insert in the cavity when the aerosol-forming insert is accommodated in the cavity. Such retaining members may for example be protrusions at the internal surface of the cavity and extending into the cavity. Preferably, protrusions are arranged in a distal region of the cavity, near or at an insertion opening where an aerosol-forming insert is inserted into the cavity of the device housing. For example, protrusion may have the form of circumferentially running ribs or partial ribs. Protrusions may also serve as aligning members for supporting an introduction of the insert into the cavity. Preferably, aligning members have the form of longitudinal ribs extending longitudinally along the circumferential portion of the inner surface of the cavity. Protrusions may also be arranged at the pin, for example extending in a radial direction. Preferably, retaining members provide for a certain grip of the insert such that the insert does not fall out of the cavity, even when the device is held upside down. However, the retaining members release the insert again preferably without damaging the insert, when a certain release force is exerted upon the insert.

According to another aspect of the invention, there is also provided an inductive heating and aerosol-generating system. The system comprises a device as described in this application with pin and induction coil extending into a cavity in a device housing and comprises an aerosol-forming insert comprising an aerosol-forming substrate and a susceptor. The aerosol-forming substrate is accommodated in the cavity of the device and arranged therein such that the susceptor of the aerosol-forming insert is inductively heatable by electromagnetic fields generated by the induction coil.

Aspects and advantages of the device have been described above and will not be repeated.

The aerosol-forming substrate is preferably a substrate capable of releasing volatile compounds that can form an aerosol. The volatile compounds are released by heating the aerosol substrate. The aerosol-forming substrate may be a solid or liquid or comprise both solid and liquid components.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

Homogenised tobacco material may be formed by agglomerating particulate tobacco. Where present, the homogenised tobacco material may have an aerosol-former content of equal to or greater than 5% on a dry weight basis, and preferably between greater than 5% and 30% by weight on a dry weight basis.

The aerosol-forming substrate may alternatively comprise a non-tobacco-containing material. The aerosol-forming substrate may comprise homogenised plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine.

The aerosol-forming substrate may comprise other additives and ingredients, such as flavourants.

The susceptor is a conductor that is capable of being inductively heated. A susceptor is capable of absorbing electromagnetic energy and converting it to heat. In the system according to the invention, the changing electromagnetic field generated by the one or several induction coils heats the susceptor, which then transfers the heat to the aerosol-forming substrate of the aerosol-forming insert, mainly by conduction of heat. For this, the susceptor is in thermal proximity to the material of the aerosol forming substrate. Form, kind, distribution and arrangement of the or of the several susceptors may be selected according to a user's need.

The high frequency current provided by the power source flowing through the induction coil may have frequencies in a range between 1 MHz to 30 MHz, preferably in a range between 1 MHz to 10 MHz, even more preferably in a range between 5 MHz to 7 MHz. The term 'in a range between' is herein understood as explicitly also disclosing the respective boundary values.

In some preferred embodiments, the aerosol-forming insert is a cartridge comprising a susceptor and containing a liquid, preferably comprising nicotine. In some other preferred embodiments, the aerosol-forming insert is a tobacco material containing unit comprising a susceptor. The tobacco containing unit may be a unit comprising a susceptor and a tobacco plug made of a homogenized tobacco material. The tobacco material containing unit may further comprise a filter arranged at a mouth end of the tobacco material containing unit.

The invention is further described with regard to embodiments, which are illustrated by means of the following drawings, wherein FIG. 1 is a schematic drawing of an inductive heating device comprising a cavity for accommodating an aerosol-forming insert, wherein a central pin extends into the cavity;

Figure 1:
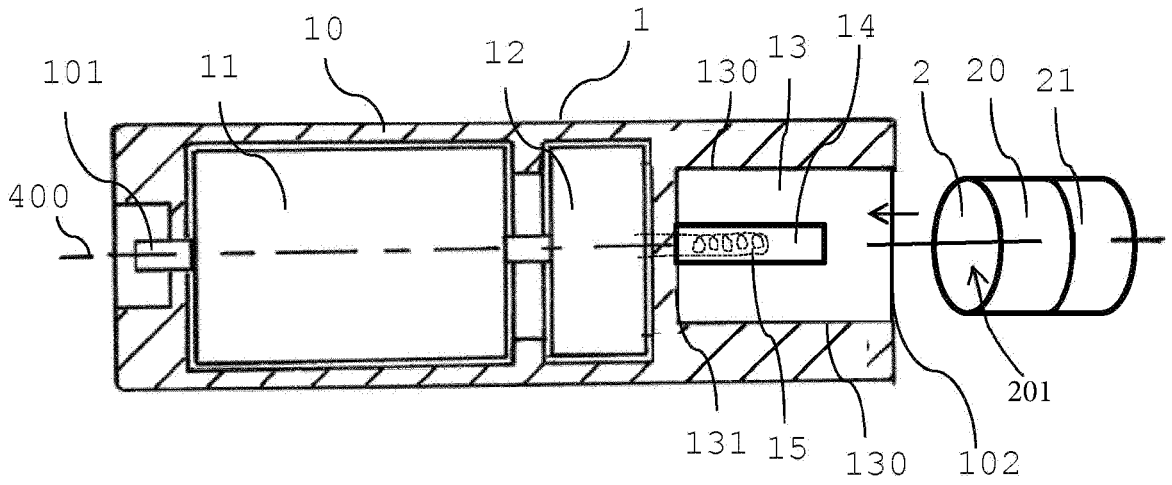

FIG. 1 schematically shows an inductive heating device 1 and an aerosol-forming insert 2 that in the mounted state of the aerosol-forming insert 2 form an inductive heating system. The inductive heating device 1 comprises a device housing 10 with a distal end having electrical contacts 101, for example a docking port comprising a pin, for connecting an internal electric power source 11 to an external power source (not shown), for example a charging device. The internal power source 11, for example a rechargeable battery 11, is provided inside the device housing in a distal region of the housing 10.

The proximal end of the device housing has an insertion opening 102 for inserting the aerosol-forming insert 2 into a cavity 13. The cavity 13 is formed inside the device housing in the proximal region thereof. The cavity 13 is configured to removably receive the aerosol-forming insert 2 inside the cavity 13. A pin 14 enclosing an induction coil 15 (indicated with dotted lines) extends into the cavity coaxially to a longitudinal axis of the cavity 400, which axis in this embodiment corresponds to the longitudinal axis of the device housing. Embodiments of the cavity and proximal region of the device housing will further be described in more detail in FIG. 2 and FIG. 3 below.

The device housing 10 further comprises electronics 12, for example a printed circuit board with circuitry. The electronics 12 as well as the induction coil receive the required power from the internal power source 11. The elements are interconnected accordingly. Proximal and distal region of the device housing are separated by at least a bottom wall 131 of the cavity 13 or further separating housing walls. By arranging the induction coil inside the pin, any electric components may be kept separate from elements or processes in the cavity. This may be the unit itself but especially also residues emerging from the heating of the unit or of parts thereof and from an aerosol generating process. Preferably, the separation of the proximal region with the cavity and the distal region with electronics 12 and power source is fluid-tight. However, ventilation openings for allowing an airflow into the proximal direction of the device 1 may be provided in cavity walls 130,131 and in the device housing or both.

The aerosol-forming insert 2 may for example comprise an aerosol-forming substrate 20, for example a tobacco material and an aerosol former containing plug. The insert 2 comprises a susceptor 201 for inductively heating the aerosol-forming substrate and may comprise a cigarette filter 21. Electromagnetic fields generated by the induction coil 15 inductively heat the susceptor in the aerosol-forming insert. The heat of the susceptor is transferred to the aerosol-forming substrate 20 thus evaporating components that may form an aerosol for inhalation by a user.

Figure 2:
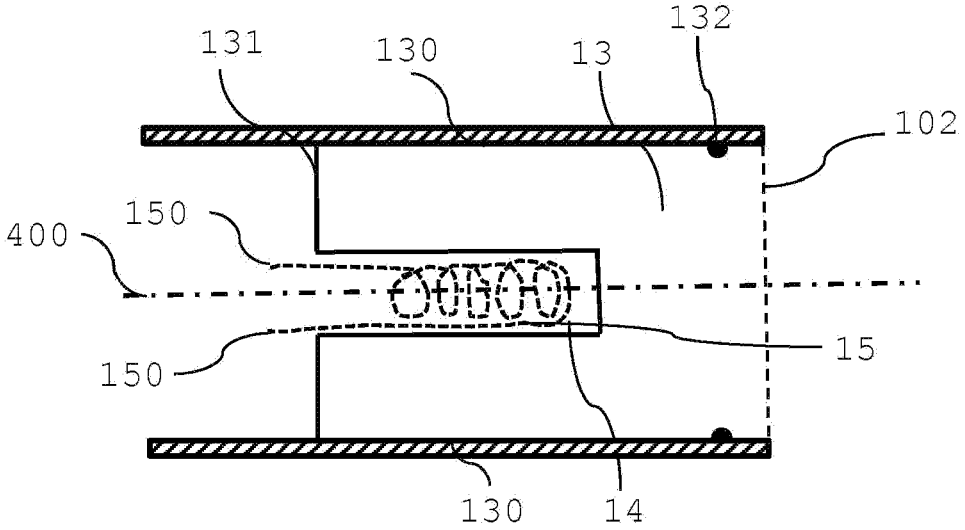
FIG. 2 shows a cross-section section of an excerpt of an inductive heating device for example as shown in FIG. 1 with a central pin having an integrated induction coil.

FIG. 2 shows an enlarged view onto a cross section of a cavity 13 with centrally arranged pin 14, for example the cavity of the inductive heating device of FIG. 1. The cavity 13 has an internal surface, which is formed by cavity walls 130, 131, which may also be device housing walls (as shown in FIG. 1). One open end of the cavity 13 forms the insertion opening 102. The pin 14 extends from the bottom wall 131 of the cavity 13 along a central longitudinal axis 400 of the cavity. The induction coil 15 is arranged inside the pin and embedded therein (indicated by dotted lines). By this, the induction coil 15 and electrical connections 150 to the induction coil have no contact to the cavity 13 or to a unit 2 accommodated in the cavity.

The induction coil 15 extends along substantially the entire length of the pin 14. The induction coil is a helical coil and is preferably made of a copper wire. The pin 14 has a length of about two third of the length of the cavity 13 and is arranged inside the cavity in its entirety. Through the insertion opening 102, an aerosol-forming unit 2, for example a tobacco plug or an aerosol-containing cartridge, may be inserted into the cavity 13. The aerosol-forming unit 2 is arrangeable in the cavity 13 such that a susceptor of the unit when the unit is accommodated in the cavity is positioned such that the susceptor is inductively heatable by electromagnetic fields generated in the induction coil 15 and currents are induced in the susceptor. The bottom wall 131 of the cavity 13 may serve as mechanical stop when introducing unit 2.

The pin 14 may be pointed at the distal tip to facilitate an alignment and insertion of the unit 2 in and into the cavity. Outer surface of pin 14 or cavity 13 may in addition be provided with retentions 132 for holding the aerosol-forming unit 2 in the cavity.

Preferably, pin 14 and cavity 13 are of cylindrical or tubular shape and are arranged concentrically. Cavity walls 131 and pin 14 and preferably also the device housing 10 may be made of the same material and are preferably made of plastics material. Preferably, cavity walls and pin are formed in one piece, for example by injection moulding.

Figure 3:
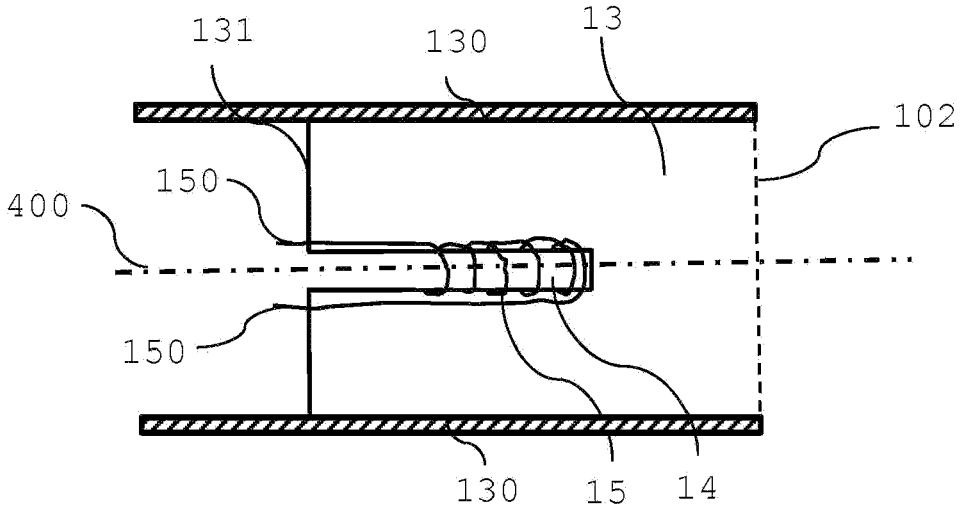
FIG. 3 shows a cross-section of an excerpt of an inductive heating device with a central pin having an induction coil wound around the pin.

FIG. 3 shows an enlarged view onto a cross section of a cavity 13 of an inductive heating device for example as described in FIG. 1. The same reference numerals as in FIG. 2 are used for the same or similar elements. The cavity 13 of FIG. 3 has a centrally arranged pin 14 extending into the cavity 13. The induction coil 15 is wound around the pin and in contact with the cavity. The induction coil 15 extends along the distal half of the pin 14.

Also in this embodiment pin 14 and cavity walls 130, 131, which may also be device walls, may be manufactured in one piece. Preferably, electric connections 150 from the induction coil 15 are led through the bottom wall 131 of the cavity 13 to a power supply in the inductive heating device. Preferably, feedthroughs are manufactured in an air-tight manner such as to not influence an airstream through or along an inserted aerosol-forming unit. Preferably, feedthroughs are manufactured such as to prevent components or substances generated in the cavity to reach the electronics 12 of the device 1.

By the central arrangement of the pin 14 in the cavity 13 as shown in FIGS. 2 and 3, basically a same amount of aerosol-forming substrate of an aerosol-forming unit 2 accommodated in the cavity 13 is to be heated in radial direction of the pin. Thus, a uniform heating is possible with the induction coil arrangement according to the invention. In addition, by a centrally arranged induction coil 15, the aerosol-forming unit or rather the susceptor provided in the unit serves as magnetic shield such that additional shielding may be omitted.

Pin and induction coil arrangements as well as the inductive heating device are shown by way of example only. Variations, for example, length, number, location or thickness of an induction coil or pin, may be applied depending on a user's need or on an aerosol-forming unit to be heated and used together with a device.

The invention claimed is:

1. Inductive heating device for aerosol-generation, the device comprising:

a device housing comprising a cavity having an internal surface configured to receive at least a portion of an aerosol-forming insert, the aerosol-forming insert comprising an aerosol-forming substrate and a susceptor, the device housing further comprising a pin extending into the cavity;

an induction coil arranged along the pin, wherein the induction coil is arranged within the pin and is not in contact with the cavity;

an internal power source connected to the induction coil a control unit operably connected to the internal power source;

wherein at least a portion of the pin and the induction coil are arranged to be circumferentially surrounded by the aerosol-forming insert when the aerosol-forming insert is accommodated in the cavity; and wherein the internal power source is configured to provide a high frequency current to the induction coil to generate electromagnetic fields for inductively heating the susceptor of the aerosol-forming insert.

2. Device according to claim 1, wherein the induction coil is moulded into the pin.

3. Device according to claim 2, wherein the pin and the induction coil are arranged along a central longitudinal axis of the cavity.

4. Device according to claim 3, wherein a circumferential portion of the internal surface of the cavity and the pin are of cylindrical shape.

5. Device according to claim 2, wherein a circumferential portion of the internal surface of the cavity and the pin are of cylindrical shape.

6. Device according to claim 1, wherein the pin and the induction coil are arranged along a central longitudinal axis of the cavity.

7. Device according to claim 6, wherein a circumferential portion of the internal surface of the cavity and the pin are of cylindrical shape.

8. Device according to claim 1, wherein a circumferential portion of the internal surface of the cavity and the pin are of cylindrical shape.

9. Device according to claim 8, wherein the pin and the induction coil are arranged along a central longitudinal axis of the cavity.

10. Device according to claim 1, wherein two or more induction coils are arranged along the pin and next to each other.

11. Device according to claim 1, wherein the pin is integrally formed with the device housing.

12. Device according to claim 1, wherein the device housing comprises retaining protrusions constructed to hold the aerosol-forming insert in the cavity when the aerosol-forming insert is accommodated in the cavity.

13. Device according to claim 1, wherein a circumferential portion of the internal surface of the cavity and the pin are of cylindrical shape.

14. Inductive heating and aerosol-generating system comprising:

an aerosol-forming insert comprising:

an aerosol-forming substrate; and a susceptor, and an inductive heating device comprising:

a device housing comprising a cavity having an internal surface configured to receive at least a portion of the aerosol-forming insert, the device housing further comprising a pin extending into the cavity, an induction coil arranged along the pin, wherein the induction coil is arranged within the pin and is not in contact with the cavity, an internal power source connected to the induction coil and configured to provide a high frequency current to the induction coil, and a control unit operably connected to the internal power source;

wherein the aerosol-forming substrate of the aerosol-forming insert is accommodated in the cavity of the device and arranged therein such that the susceptor of the aerosol-forming insert is inductively heated by electromagnetic fields generated by the induction coil, and wherein at least a portion of the pin and the induction coil are arranged to be circumferentially surrounded by the aerosol-forming insert.

15. System according to claim 14, wherein the aerosol-forming insert is one of a cartridge comprising the susceptor and containing a liquid, and a tobacco material containing unit comprising the susceptor.

* * * * *